US010815027B2

(12) United States Patent
Gatewood

(10) Patent No.: US 10,815,027 B2
(45) Date of Patent: Oct. 27, 2020

(54) PULL TAB FOR COLLECTION AND DISTRIBUTION OF JUICE INTO A BEVERAGE CONTAINER

(71) Applicant: Ball Corporation, Broomfield, CO (US)

(72) Inventor: Erik E. Gatewood, Arvada, CO (US)

(73) Assignee: Ball Corporation, Broomfield, CO (US)

( * ) Notice: Subject to any disclaimer, the term of this patent is extended or adjusted under 35 U.S.C. 154(b) by 913 days.

(21) Appl. No.: 14/823,514

(22) Filed: Aug. 11, 2015

(65) Prior Publication Data

US 2016/0039565 A1 Feb. 11, 2016

Related U.S. Application Data

(60) Provisional application No. 62/035,923, filed on Aug. 11, 2014.

(51) Int. Cl.

| | |
|---|---|
| ***B65D 17/00*** | (2006.01) |
| ***B65B 69/00*** | (2006.01) |
| ***B65D 17/28*** | (2006.01) |

(52) U.S. Cl.

CPC .. *B65D 17/4012* (2018.01); *B65D 2517/0014* (2013.01); *B65D 2517/0056* (2013.01)

(58) Field of Classification Search

None

See application file for complete search history.

(56) References Cited

U.S. PATENT DOCUMENTS

| | | | | |
|---|---|---|---|---|
| 3,669,013 | A | 6/1972 | Stein | |
| 4,927,048 | A * | 5/1990 | Howard | B65D 41/52 215/232 |
| 5,131,555 | A | 7/1992 | Demars et al. | |
| 5,375,729 | A | 12/1994 | Schubert | |
| 5,555,993 | A | 9/1996 | Borkowski et al. | |
| 5,743,445 | A * | 4/1998 | Benarrouch | B65D 17/4012 222/541.9 |
| 7,798,056 | B2 | 9/2010 | Kramer | |
| 7,975,884 | B2 | 7/2011 | Mathabel et al. | |
| 8,146,768 | B2 | 4/2012 | Forrest et al. | |
| 8,627,978 | B2 | 1/2014 | Nishibe et al. | |
| 9,592,569 | B2 | 3/2017 | Reed et al. | |

(Continued)

FOREIGN PATENT DOCUMENTS

| | | |
|---|---|---|
| AU | 2013302931 | 2/2014 |
| EP | 2836440 | 5/2017 |

(Continued)

OTHER PUBLICATIONS

Official Action for Canada Patent Application No. 2,957,753, dated Dec. 11, 2017 3 pages.

(Continued)

*Primary Examiner* — Hemant Desai
*Assistant Examiner* — Tanzim Imam
(74) *Attorney, Agent, or Firm* — Sheridan Ross P.C.

(57) ABSTRACT

An end closure for food and beverage containers is provided which comprises a novel pull tab for collecting and distributing juice from fruit or vegetables into a pour opening in the end closure of the container. In some embodiments, the pull tab comprises a catch basin, raised rim, and fluid flow openings.

10 Claims, 3 Drawing Sheets

(56) References Cited

U.S. PATENT DOCUMENTS

| | | | | |
|---|---|---|---|---|
| 2006/0162578 | A1 | 7/2006 | Zellmer et al. | |
| 2006/0163254 | A1 | 7/2006 | Wichelhaus | |
| 2013/0075401 | A1 | 3/2013 | Forrest | |
| 2013/0118133 | A1 | 5/2013 | Jacober et al. | |
| 2013/0134065 | A1* | 5/2013 | Schorre ..... | B65D 17/4012 206/459.5 |
| 2014/0061212 | A1 | 3/2014 | Jacober et al. | |
| 2016/0052668 | A1 | 2/2016 | Gatewood et al. | |
| 2017/0043903 | A1 | 2/2017 | Gogola et al. | |
| 2017/0101214 | A1 | 4/2017 | McEldowney et al. | |

FOREIGN PATENT DOCUMENTS

| | | |
|---|---|---|
| GB | 1714339.7 | 9/2017 |
| WO | WO 2013/049313 | 4/2013 |
| WO | WO 2017/027802 | 2/2017 |

OTHER PUBLICATIONS

International Search Report and Written Opinion for International (PCT) Patent Application No. PCT/US15/46142, dated Nov. 12, 2015, 8 pages.

International Search Report and Written Opinion for International (PCT) Patent Application No. PCT/US15/44657, dated Oct. 30, 2015, 9 pages.

International Preliminary Report on Patentability for International (PCT) Patent Application No. PCT/US15/44657, dated Feb. 23, 2017, 8 pages.

Notice of Allowance for Canada Patent Application No. 2,957,753, dated Sep. 28, 2018 1 page.

* cited by examiner

PULL TAB FOR COLLECTION AND DISTRIBUTION OF JUICE INTO A BEVERAGE CONTAINER

CROSS-REFERENCE TO RELATED APPLICATION

This application claims priority to and the benefit of U.S. Provisional Patent Application Ser. No. 62/035,923, filed Aug. 11, 2014, the entire disclosure of which is incorporated by reference herein.

FIELD OF THE INVENTION

Embodiments of the present invention generally relate to containers, container end closures, and more specifically metallic beverage container end closures with novel pull tabs for collecting and distributing juice into the containers.

BACKGROUND OF THE INVENTION

Containers, and more specifically metallic beverage containers, generally contain an end closure with a pull tab or other form of stay on tab ("SOT") to sever a score and form a pour opening. Users often like to squeeze fresh fruit juice, e.g., lemon, lime, or orange, into the contents of their beverage containers, especially for beer, vodka, other alcoholic beverages, and soft drinks. This may be achieved by squeezing the fruit above the container's pour opening in hopes that most of the juice will make it into the container. The user may also shove the fruit into the container through the pour opening. Multiple problems with these methods exist. First, juice is often spilled on the user or on areas surrounding the container, such as tables and chairs. Second, only a portion of the juice makes it into the container through the pour opening because juice is often spilled on the container end closure, or on the user, and eventually ends up in the moat formed by the countersink of the end closure. Third, container end closures may have the opportunity to become dirty during the transportation of the beverage containers. Specifically, the moat collects dirt and other debris. Thus, when juice is squeezed onto the end closure or collects in the moat, the juice carries with it the dirt and debris. Accordingly, when the user drinks the beverage, the dirty juice can flow into the user's mouth via the moat. Fourth, the user can cut his finger on the pour opening as he tries to push the fruit into the pour opening, which is usually smaller than the piece of fruit.

Accordingly, there exists a significant need for a beverage container end closure that assists a user in squeezing fresh juice into the container contents.

SUMMARY OF THE INVENTION

These and other needs are addressed by the various embodiments and configurations of the present invention. This invention relates to a novel system, device, and methods for providing a food and beverage container end closure with a pull tab for juice collection and distribution into the container. Note that the terms "pull tab" and "tab" may be used interchangeably herein. The novel end closure provided herein allows the user to easily and effectively get fresh juice into the container.

Features of the present invention may be employed in a wide range of food and beverage containers, including pressurized beverage containers with stay on tabs ("SOTs") secured by a rivet, food containers with tear away lids, and full-panel easy-open end tabs, to name a few. Although the invention generally relates to metallic end closures and containers, the invention and features described herein could easily be implemented on plastic containers and end closures.

Thus, it is one aspect of various embodiments of the present invention to provide a metallic end closure with a tab that assists in the collection and distribution of juice into the container. One aspect of various embodiments of the present invention is to provide an end closure that directs freshly squeezed juice into the container contents. One advantage of some embodiments is that less fruit juice is spilled on the user and/or surrounding areas when the user squeezes juice into the container. Additionally, more juice ends up in the container rather than on the user, on surrounding areas, or in the countersink. Thus, embodiments of the present invention are less messy and less sticky due to the reduced juice spillage.

Another aspect of embodiments of the present invention is to provide a container end closure that safely enables a user to squeeze juice into the container. Thus, the end closure of the present invention reduces the likelihood a user will cut himself on the end closure while trying to get juice into the container.

One aspect of embodiments of the present invention is to provide a novel pull tab for the collection and distribution of juice. In some embodiments, the novel pull tab can be used with any size, shape, or type of end closure.

In various embodiments, an end closure for directing juice into a container is provided with a SOT, the end closure comprising: a peripheral curl which is adapted for interconnection to a neck of a beverage container; a chuck wall extending downwardly from the peripheral curl; a countersink interconnected to a lower end of the chuck wall; an inner panel wall extending upwardly from an interior portion of the countersink; a central panel interconnected to an upper portion of the inner panel wall; a score line in the central panel which defines a tear panel for an opening; a pull tab operably interconnected to the central panel at an interconnection point, wherein the pull tab comprises: a nose positioned proximate to the tear panel; a tail end positioned opposite the nose; a catch basin positioned between the tail end and the interconnection point; a raised edge extending around a portion of a perimeter of the pull tab; and a pour portion, wherein juice is collected in the catch basin and directed toward the nose and into the opening. In some embodiments, the nose portion has one or more apertures to allow drainage of the juice, or alternately is shaped into a funnel-shaped pour spout. In further embodiments, the central panel has a first surface area and the pull tab has a second surface area, and wherein the second surface area is at least about 25% of the first surface area, and preferably at least about 33% of the first surface area. Additionally, the nose has a width that is less than 40% of a width of the catch basin.

In some embodiments, a pull tab for collecting and redirecting a liquid into a container opening is provided, the pull tab comprising: a nose positioned proximate to the container opening; a rivet positioned proximate to the nose, the rivet is adapted for interconnecting the pull tab to an end closure of a container; a tail end positioned opposite the nose; a catch basin positioned between the nose and the tail end; a raised edge extending around at least a portion of a perimeter of the pull tab to define the catch basin; and a channel positioned proximate to the nose, wherein juice is collected in the catch basin and directed toward the channel when the tail end of the pull tab is raised. In one embodiment, at least a portion of the nose is positioned over the container opening. In further embodiments, the catch basin has a surface area of at least about 0.35 square inches. In various embodiments, the raised edge extends upwardly around the entire pull tab with a height of at least about 0.04 inches. In further embodiments, the channel has a width of at least about 0.06 inches. In one embodiment, the tail end extends across an entire central panel of an end closure. Additionally, the pull tab includes a sanitary adhesive covering positioned over the catch basis of the pull tab, wherein the sanitary adhesive covering can be selectively removed. Some pull tabs are comprised of at least one of a metallic and a plastic material. In various embodiments, at least one of indicia, laser marking, graphics, or colored design is provided on an upper surface of the pull tab. In additional embodiments, the catch basin of the pull tab has a non-linear cross-sectional shape.

Various methods of introducing juice into a beverage container are provided. In one embodiment, a method is provided comprising: providing an end closure including a tear panel defining an opening, a central panel, and a pull tab operably interconnected to the central panel at an interconnection point, wherein the pull tab comprises: a nose positioned proximate to the tear panel; a tail end positioned opposite the nose; a raised edge extending around a portion of a perimeter of the pull tab; a catch basin positioned between the tail end and the interconnection point and at least partially defined by the raised edge; and a pour portion; opening the opening by separating the tear panel from the central panel; pushing fruit on an upper surface of the catch basin of the tab to extract juice from a fruit; and directing the juice toward the pour portion and into the opening.

Embodiments of the present invention function with fruit and vegetables. Accordingly, it should be assumed that any time the term "fruit" is used herein, it should be understood that "fruit or vegetable" is meant.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about".

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

Those of skill in the art will recognize that the following description is merely illustrative of the principles of the invention, which may be applied in various ways to provide many different alternative embodiments. This description is made for illustrating the general principles of the teachings of this invention and is not meant to limit the inventive concepts disclosed herein.

The accompanying drawings, which are incorporated in and constitute a part of the specification, illustrate embodiments of the invention and together with the general description of the invention given above and the detailed description of the drawings given below, serve to explain the principles of the invention.

Figure 1:
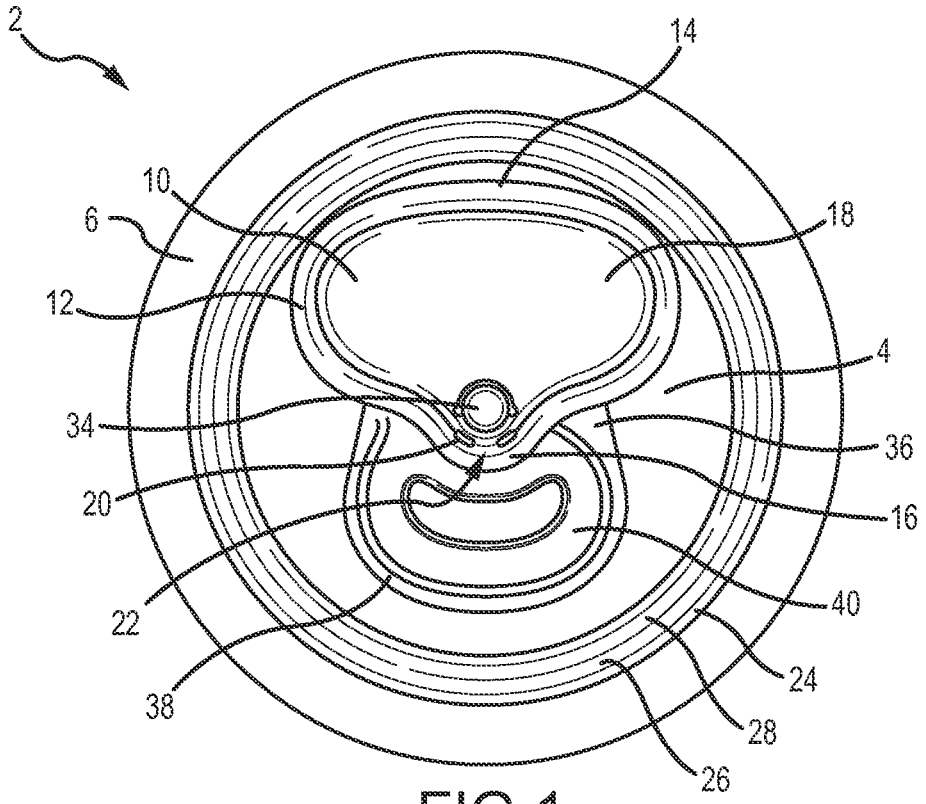
FIG. 1 is a top plan view of one embodiment of an end closure with a pull tab for juice collection and distribution into the beverage container shown in a closed position with the pull tab in a substantially flat position.

To assist in the understanding of the embodiments of the present invention the following list of components and associated numbering found in the drawings is provided herein:

| No. | Component |
|---|---|
| 2 | End Closure |
| 4 | Central Panel |
| 6 | Container Body |
| 10 | Pull Tab |
| 12 | Tab Rim or Tab Peripheral Rim |
| 14 | Pull Tab Tail |
| 16 | Pull Tab Nose |
| 18 | Catch Basin |

-continued

| No. | Component |
|---|---|
| 20 | Fluid Flow Opening |
| 22 | Fluid Channel |
| 24 | Top of Double Seem |
| 26 | Chuck Wall |
| 28 | Countersink |
| 34 | Rivet |
| 36 | Deboss Area |
| 38 | Score Line |
| 40 | Tear Panel |
| 42 | Pour Opening |
| W1 | Width Pull Tab |
| W2 | Width of Nose of Pull Tab |
| W3 | Width of Catch Basin |
| L1 | Length of Pull Tab (from nose to tail) |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

FIG. 1 shows a first embodiment of an end closure 2 double seemed onto a container body 6. The end closure 2 comprises a central panel 4, a pull tab 10 interconnected to the central panel 4 via a rivet 34 or other interconnection means, a chuck wall 26, and a countersink 28. The top of the double seem 24 can also be seen in FIG. 1. The central panel 4 comprises a deboss area 36 and a score line 38, which defines a tear panel 40. The tear panel 40 can also include a deboss area. Additionally, a second score line may be included and run parallel to the first score line 38. The end closure 2 is shown in a closed position, i.e., the opening is closed because the tear panel 40 has not yet been separated from the rest of the central panel 4. Additionally, the pull tab 10 is in an initial, substantially flat position. Thus, in this position the tab 10 is substantially parallel to the central panel 4 and the underside of the tab 10 is positioned relatively flush against an upper surface of the central panel 10.

One novelty of the pull tab 10 is that it can be used with any size, shape, or type of end closure 2. Thus, alternate embodiments include a different end closure interconnected to a tab 10 similar to the tab 10 shown in FIG. 1. In the embodiment shown, the tab 10 includes a nose 16 proximate to the tear panel 40 and a tail end (also called a "tail" or "pull end") 14 opposite the nose 16. The rivet 34 is also positioned proximate to the nose 16 of the pull tab 10. To open the container, the user pulls on the tail end 14 of the tab such that the nose 16 pushes on the tear panel 40 and fractures the score line 38 to separate the tear panel 40 from the central panel 4 to create the pour opening (42 in FIG. 2). The pull tab 10 also includes a rim 12 along a portion of the outer perimeter of the pull tab 10, a catch basin 18, one or more fluid flow openings 20, and a fluid channel 22 positioned between the fluid flow openings 20. The rim 12 can be raised above the other portions of the pull tab 10. In various embodiments, the raised edge extends upwardly around the pull tab with a height of at least about 0.04 inches. In one embodiment, the raised edge extends upwardly around the entire pull tab with a height between about 0.04 inches and about 0.25 inches. In another embodiment, the raised edge extends upwardly around the entire pull tab with a height between about 0.06 inches and about 0.15 inches. In one embodiment, the raised edge extends upwardly around a portion of the pull tab with a height between about 0.06 inches and about 0.15 inches. In one embodiment, the rim 12 has a height above the catch basin 18 of between about 0.15 inches and about 0.03 inches. In a preferred embodiment, the rim 12 has a height above the catch basin 18 of between about 0.10 inches and about 0.06 inches. In a more preferred embodiment, the rim 12 has a height of about 0.08 inches above the catch basin 18. Thus, at least a portion of the catch basin 18 is surrounded by the rim 12 and the catch basin 18 is positioned between the rivet 34 and the tail 14 of the pull tab 10. Further, the raised edge or rim 12 may have varying heights at different points along the perimeter of the tab 10 in some embodiments. For example, the height of the rim 12 proximate to the tail end 14 of the tab 10 may be taller than the height of the rim 12 proximate to the nose 16 or other spout, pour portion, or channel 22 to which the juice is desired to be directed. Note that in the embodiment shown, the nose comprises the channel 22 and the terms "channel," "pour portion," and "spout" can be used interchangeably herein. The varying heights further assist in directing juice into the catch basin 18 and ultimately into the container. In some embodiments, the rim 12 of the tab 10 may extend around the entire tab perimeter, while in other embodiment the rim 12 may only extend around a portion of the tab's perimeter. For example, the rim 12 of the tab 10 may extend around the tail end 14 of the tab 10 and the catch basin 18, but not around the nose 16 of the tab 10. This configuration may create a funnel, luge, or trough to direct the juice to the nose 16 and then to the pour opening.

In the embodiment shown, the tab 10 does not have an opening positioned proximate to the tail end 14 of the tab 10, nor does the tab 10 have a lift ring or pull ring like many pull tabs of the prior art. This is because the portion of the tab 10 on the side of the rivet 34 opposite the tear panel 40 can act as a catch basin to collect juice squeezed from fruit or vegetables. Further, some embodiments of the invention include a raised perimeter or rim 12 around at least a portion of the tab 10, which can, for example, be the portion of the tab 10 comprising the catch basin 18. Thus, the center of the catch basin 18 is positioned lower than the perimeter of the catch basin or rim 12, which helps direct the juice into the catch basin 18. In some embodiments, the catch basin has a curved or arcuate shape when viewed in cross-section. Thus, the portion of the catch basin positioned proximate the center of the catch basin is lower than the portion of the catch basin proximate the rim or perimeter. The curved shape of the catch basin may further help direct juice flow.

The portion of the tab 10 proximate to the tail end 14 is wider than the tail ends of standard SOTs and is wider than the nose 16 of the tab 10 in order to provide a larger area to collect freshly squeezed juice and to accommodate slices of fruit that are wider than standard SOTs. Accordingly, a user can place a fruit or vegetable slice on the tab 10, specifically on the catch basin 18, and push the fruit or vegetable slice into the tab 10 such that juice is squeezed out of the fruit or vegetable slice. The rim 12 keeps at least a portion of the juice contained within the catch basin 18 such that when the user lifts the tail 14 of the pull tab 10, the juice is directed toward the nose 16, which is positioned at least partially above the pour opening. Further, the juice is directed toward the one or more fluid flow openings 20 and into the container. For example, a user can place a lime slice on the catch basin 18 (peel side up and fruit side down on the catch basin 18) and push on the lime slice to squeeze juice out of the lime slice. The nose 16 of the tab 10 is narrower than the tail end 14 of the tab 10, which allows the nose 16 to open the tear panel 40 by creating enough pressure at one point to fracture the score line 38. Additionally, having a nose 16 that is narrower than the tail end 14 and catch basin 18 allows the tab 10 to act like a funnel and direct the juice into the pour opening.

The tab 10 can comprise any number of fluid flow openings 20 (two are shown in FIG. 1) and the fluid flow openings 20 can be any shape or size. Thus, the fluid flow openings may be larger or smaller than the fluid flow openings 20 shown in FIG. 1. Additionally, the fluid flow openings 20 may be positioned in a different position in other embodiments. However, the fluid flow openings 20 should be positioned in the portion of the tab 10 proximate to the pour opening such that the juice is directed into the pour opening and into the container. In the embodiment shown, the nose 16 is positioned proximate to the tear panel 40 and pour opening; thus, the pour openings 20 are positioned proximate the nose 16 of the tab 10. Further, the fluid flow openings 20 may be positioned in a lowermost portion of the nose 16, spout, or pour portion to enable the juice to flow toward and through the fluid flow openings 20. In some embodiments, the channel 22 is positioned between the fluid flow openings 20, while in other embodiments, the fluid flow openings 20 are positioned in the channel 22. In one embodiment, the channel has a width of at least about 0.06 inches. In a preferred embodiment, the channel has a width between about 0.06 inches and about 0.50 inches. In a more preferred embodiment, the channel has a width between about 0.08 inches and about 0.30 inches. The fluid flow openings 20 may be of particular importance if the nose 16, spout, or pour portion includes a raised edge that has a height that is taller than the catch basin height because then the fluid flow openings 20 can be positioned in a lower portion of the nose 16, spout, or pour portion and use gravity such that the juice flows from the catch basin 18 toward and through the fluid flow openings 20. This is possible if the fluid flow openings 20 are positioned at a height below the height of the catch basin 18. Additionally, the fluid flow openings 20 may be positioned below the catch basin 18 when the tab 10 is angled slightly toward the pour opening (i.e., in the raised position). Thus, any remaining juice in the catch basin 18 can slowly drain through the fluid flow openings 20 and into the container over time. Additionally, any remaining juice is positioned near the user's nose while drinking from the container. This provides olfactory stimulation, which is another advantage of embodiments of the present invention.

In the embodiment shown, the tab 10 is larger than standard pull tabs. Specifically, the area of the tab 10 is equal to or greater than 25% of the surface area of the central panel 4, and in some embodiments at least 33% of the surface area of the central panel 4. Thus, the tab 10 covers a large portion of the central panel 4.

In some embodiments, the end closure 2 may comprise a spout or pour portion such that the juice is directed over or across the spout or pour portion and into the container. The spout or pour portion can also include one or more fluid flow openings. If the tab has a spout or pour portion with a raised edge that is higher or taller than the catch basin, then the tab must be angled at least slightly such that the spout or pour portion is positioned below the catch basin in order to direct the juice from the catch basin, across the spout or pour portion, and into the opening. In further embodiments, the pour portion of the tab may comprise a weir or other break in the raised portion to allow juice to flow through the weir. In the embodiment shown, if the nose 16 (or other portion in other embodiments) is not positioned lower than the catch basin 18, then the user must lift the tail end 14 of the tab 10 such that the tab 10 is positioned at an angle with the tail 14 raised above the nose 16. This position allows the juice to flow to the nose 14 and in the pour opening. Thus, after a user pulls on the pull end 14 of the tab 10 and opens the container by fracturing the score line 38 around the tear panel 40, the tab 40 may remain angled slightly toward the opening. The user may have to push the tail end 14 of the tab 10 downward such that the tab 10 is in a lowered position (see FIG. 2) and the user can easily push the fruit or vegetable on the tab 10. Then the user will need to raise the tail end 14 of the tab 10 to put the tab 10 in an angled or raised position (see FIG. 3) to direct the juice from the catch basin 18 toward the nose 16, fluid flow openings 20, spout, or pour portion and eventually into the pour opening.

The shape of the tab 10 is also of importance. In one embodiment, the tab 10 and/or the rim 12 of the tab 10 are angled toward the pour opening forming a V-shape pointing toward the pour opening. Thus, the tab 10 acts like a funnel directing the flow of the juice from the catch basin 18 into the container. In the embodiment shown, the tail end 14 of the tab 10 and the catch basin 18 form an ovular shape and the nose 16 extends from the ovular-shaped portion. The nose 16 has a rounded V-shape when viewed from above. In alternate embodiments, the V-shaped nose 16 may extend directly from the two ends of the oval such that the rim 12 positioned along the V is substantially linear (i.e., there is not a bend in each side of the V).

Figure 2:
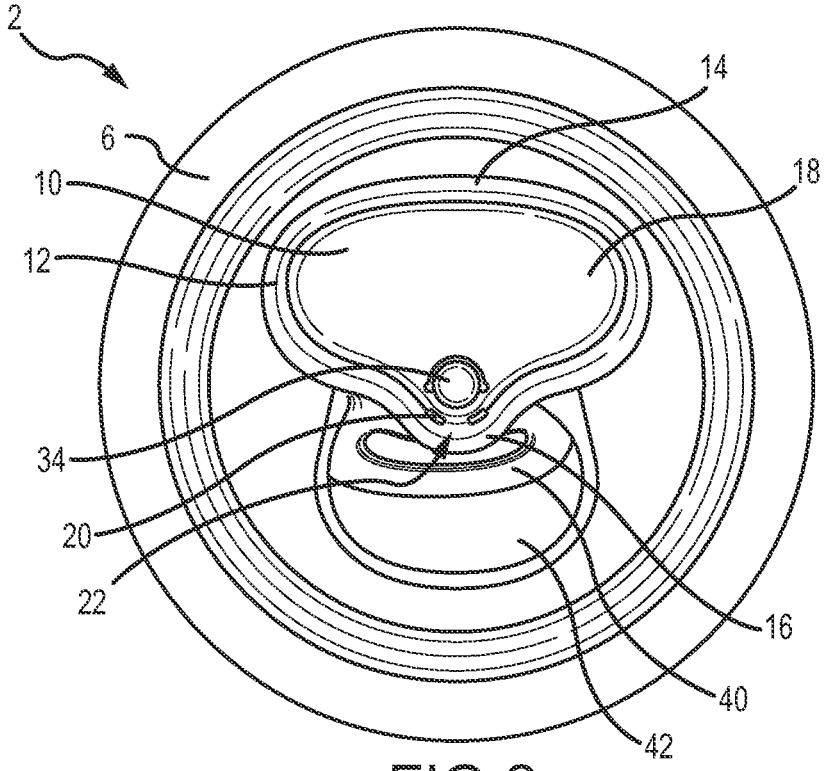
FIG. 2 is a top plan view of the end closure with a pull tab for juice collection and distribution into the beverage container shown in an open position with the pull tab in a lowered position.

FIG. 2 shows the end closure 2 of FIG. 1 in the open position and the pull tab 10 in the lowered position. Here the tear panel 40 has been separated from the central panel 4 to form the pour opening 42. After opening the pour opening 42, the tab 10 is in a slightly angled position where the nose 16, spout, or pour portion of the tab 10 is positioned below the tail end 14 of the tab 10. Before squeezing fruit or vegetables on the pull tab 10, the user will likely push the tail 14 of the pull tab 10 down such that the tab 10 is in a lowered position. Here the tab 10 will be substantially flat a parallel to the central panel 4 like FIG. 1, but the tail will be slightly raised compared to the tab 10 position shown in FIG. 1.

Figure 3:
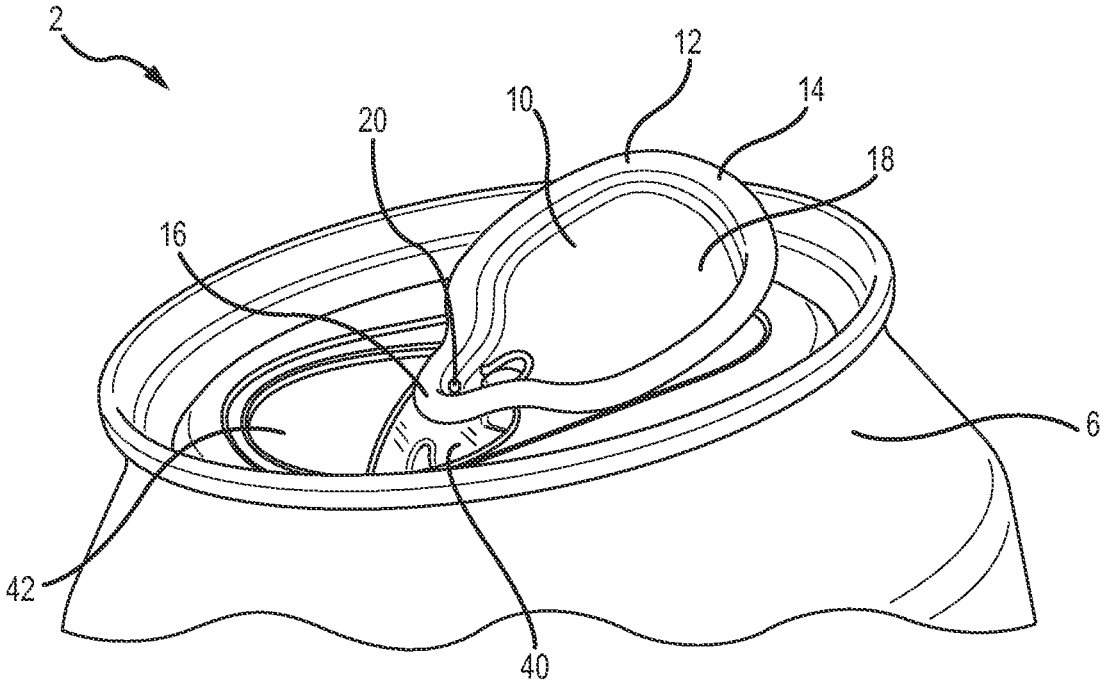
FIG. 3 is a side perspective view of the end closure with a pull tab for juice collection and distribution into the beverage container shown in an open position with the pull tab in a raised position.

FIG. 3 is a side perspective view of the end closure 2 of FIG. 2 in an open position with the pull tab 10 in a raised position. FIG. 3 further shows the angle of the tab 10 after the pour opening has been opened, the juice has been squeezed into the tab 10, and the user has raised the pull tab 10 to direct the juice into the pour opening 42. Thus, the nose 16, spout, or pour portion of the tab 10 is positioned below the tail end 14 of the tab 10.

Figure 4:
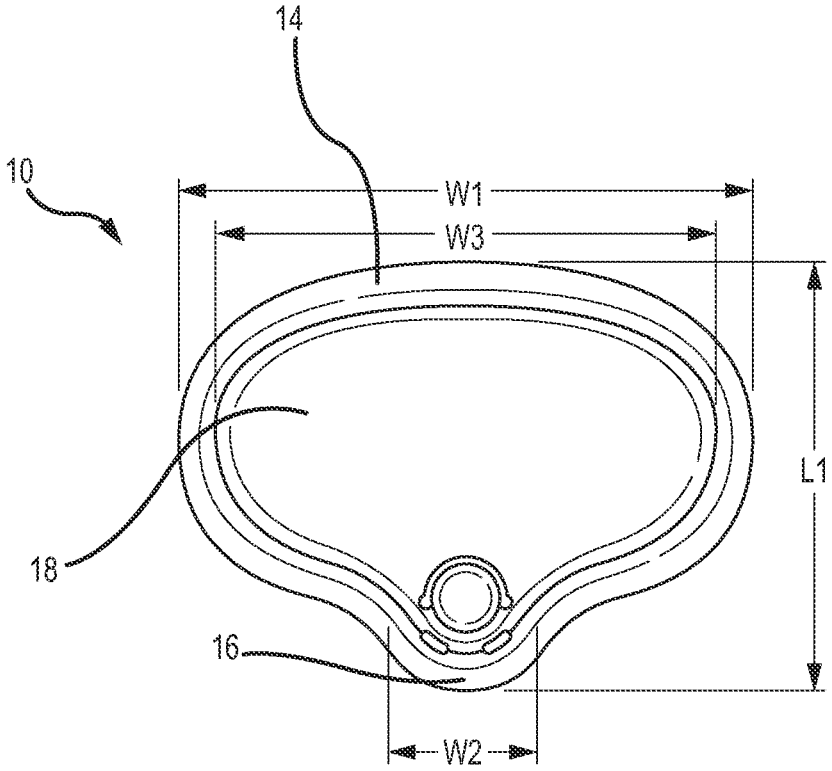
FIG. 4 shows one embodiment of a pull tab for juice collection and distribution into a beverage container.

FIG. 4 shows one embodiment of a pull tab 10 for juice collection and distribution into a beverage container. The pull tab 10 has a length L1 extending from the nose 16 of the pull tab 10 to the tail 14 of the tab 10. In one embodiment, the length L1 of the tab 10 is between about 1.70 inches and about 0.85 inches. In another embodiment, the length L1 of the tab 10 is between about 1.50 inches and about 1.00 inch. The width W1 of the pull tab 10 extends from one side (e.g., left) of the pull tab 10 to the other side (e.g., right) of the pull tab 10. In one embodiment, the width W1 of the tab 10 is between about 2.30 inches and about 1.14 inches. In another embodiment, the width W1 of the tab 10 is between about 2.10 inches and about 1.40 inches. The width W2 of the nose 16 of the pull tab 10 can be measured at different locations. When measuring the width W2 of the nose 16 at the location shown in FIG. 4, the width W2 of the nose 16 is between about 0.80 inches and about 0.25 inches in one embodiment, and between about 0.70 inches and about 0.35 inches in another embodiment. The width W3 of the catch basin 18 extends from one side (e.g., left) of the catch basin 18 to the other side (e.g., right) of the catch basin 18. In one embodiment, the width W3 of the catch basin 18 is between about 2.0 inches and about 1.0 inch. In another embodiment, the width W3 of the catch basin 18 is between about 1.75 inches and about 1.25 inches. In one embodiment, the catch basin 18 has a surface area of at least about 0.35 square inches. In a preferred embodiment, the catch basin 18 has a surface area of between about 0.50 square inches and about 2.50 square inches. In a more preferred embodiment, the catch basin 18 has a surface area of between about 1.00 square inches and about 2.00 square inches.

In alternate embodiments of present invention, the tab can have a variety of shapes and sizes. For example, the tab can be larger or smaller, circular, triangular, or any other shape. Additionally, the fluid flow openings may be larger or shaped differently in alternate embodiments. Further, only one fluid flow opening can be used or three or more fluid flow openings can be used.

Some embodiments of the present invention can have a nose, spout, or pour portion that is not V-shaped like the embodiment shown in FIGS. 1-4 and the spout or pour portion may not be a part of the nose. Thus the spout or pour portion can extend from a portion of the tab other than the nose of the tab (e.g., the tail end, a side of the catch basin, etc.). In this embodiment, if the nose is positioned above the tear panel and pour opening, then the tab will have to be rotated before the user squeezes the fruit on the tab such that the spout or pour portion is positioned above the opening to ensure the juice flows into the container.

In additional embodiments, the tab may be configured similar to the tab shown in FIGS. 1-4, but the tab may further include one or more debosses, grooves, troughs, or channels oriented toward the pour opening (e.g., toward the nose in the embodiment shown in the figures) or toward the spout or pour portion in order to direct the juice flow toward the pour opening.

In one embodiment, the end closure includes a protuberance, bead, or projection positioned below the tail end of the tab or below the catch basin. Alternatively, the lower surface of the tab can comprise a protuberance, bead, or projection extending toward the central panel. The protuberance is raised above the central panel such that it pushes on the tail end or catch basin of the tab in order to angle the tab toward the opening, i.e., raise an edge away from the pour opening a height above an edge proximate to the opening to use gravity in directing the juice into the pour opening.

In some embodiments, the tab may further include bumps, protuberances, or other raised portions on the public side of the catch basin. The user pushes the piece of fruit on the catch basin with raised portions, which assist the user in squeezing as much juice as possible out of a piece of fruit.

In various embodiments of the present invention, a container end closure is provided with a pull tab for juice collection and distribution into a beverage container. The pull tab can have a nose, tail end, and catch basin. The catch basin can further include openings such that after a user opens the pour opening, the user can rotate the tab to position the catch basin over the pour opening. Then the user can push or squeeze a piece of fruit onto the tab (specifically the catch basin) and the juice from the fruit will flow into the catch basin and through the holes of the catch basin and into the container. Additionally, the tab may have channels or a deboss to direct the juice toward the holes or the tab may have a shallow funnel around each hole to funnel the juice into the holes. Before drinking the container contents, the user may have to rotate the tab such that the catch basin is no longer positioned above the opening.

In some embodiments, the tab could include indicia, laser markings, graphics, or a colored design on an upper surface of the pull tab. For example, the tab could look like a piece or fruit or have a piece of fruit embossed or drawn on the tab.

In one embodiment, the tab includes a cover, sanitary adhesive covering, or protective film, such as a piece of foil, cellophane, or tape material, to keep the tab clean and free of dirt and debris. The cover or sanitary adhesive covering can be positioned over the catch basis of the pull tab and can be selectively removed. Thus, the user can remove the cover before pushing the fruit on the tab.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. It is to be understood that the phraseology and terminology used herein is for the purpose of description and should not be regarded as limiting.

What is claimed is:

1. A pull tab for collecting and redirecting a liquid into a container opening, the pull tab comprising:

a nose positioned proximate to said container opening;

a rivet positioned proximate to said nose, said rivet adapted for interconnecting said pull tab to an end closure of a container;

a tail end positioned opposite said nose;

a raised edge extending around at least a portion of a perimeter of said pull tab, wherein said nose is positioned on a first side of said rivet and said tail end is positioned on a second side of said rivet when said container opening is closed and when said container opening is open, a solid panel with no openings between said tail end and said rivet, wherein said solid panel is shaped to retain the liquid;

a channel positioned proximate to said nose, wherein the liquid is collected in said solid panel and directed into said channel when said tail end of said pull tab is raised; and at least two fluid flow openings proximate to said nose of said pull tab, wherein said channel is positioned between said at least two fluid flow openings.

2. The pull tab of claim 1, wherein at least a portion of said nose is positioned over said container opening.

3. The pull tab of claim 1, wherein said solid panel has a surface area of at least 0.35 square inches.

4. The pull tab of claim 1, wherein said raised edge extends upwardly around the entire pull tab with a height of at least 0.10 inches.

5. The pull tab of claim 1, wherein said channel has a width of at least 0.06 inches.

6. The pull tab of claim 1, wherein said tail end extends across an entire central panel of the end closure.

7. The pull tab of claim 1, further comprising a sanitary adhesive covering positioned over said solid panel of said pull tab, wherein said sanitary adhesive covering can be selectively removed.

8. The pull tab of claim 1, wherein said pull tab is comprised of at least one of a metallic material and a plastic material.

9. The pull tab of claim 1, wherein at least one of indicia, a laser marking, graphics, or a colored design is provided on an upper surface of said pull tab.

10. The pull tab of claim 1, wherein said end closure comprises:

a peripheral curl which is adapted for interconnection to a neck of the container;

a chuck wall extending downwardly from said peripheral curl;

a countersink interconnected to a lower end of said chuck wall;

an inner panel wall extending upwardly from an interior portion of said countersink;

a central panel interconnected to an upper portion of said inner panel wall; and a score line in said central panel which defines a tear panel for the container opening.

* * * * *